US005195938A

United States Patent [19]

Robertson

[11] Patent Number: 5,195,938

[45] Date of Patent: Mar. 23, 1993

[54] ABDOMINAL EXERCISING DEVICE

[75] Inventor: Kevin R. Robertson, Cocoa, Fla.

[73] Assignee: KR Innovations Inc., Cocoa, Fla.

[21] Appl. No.: 902,480

[22] Filed: Jun. 19, 1992

Related U.S. Application Data

[63] Continuation of Ser. No. 795,289, Nov. 19, 1991, abandoned, which is a continuation of Ser. No. 557,618, Jul. 24, 1990, abandoned.

[51] Int. Cl.[5] ..... A63B 21/00

[52] U.S. Cl. ..... 482/131; 482/92; 482/126; 482/132; 482/140

[58] Field of Search ..... 482/13, 92, 124, 126, 482/127, 131, 132, 139, 140, 908; 128/25 R, 30.2; 434/247

[56] References Cited

U.S. PATENT DOCUMENTS

| | | | |
|---|---|---|---|
| 620,346 | 2/1899 | Mueller | 272/126 |
| 2,163,107 | 6/1939 | Shatto et al. | 482/105 |
| 2,280,274 | 4/1942 | Wildermuth | 272/126 X |
| 2,754,817 | 7/1956 | Nemeth . | |
| 3,109,651 | 11/1963 | Wheeler | 272/126 X |
| 3,204,955 | 9/1965 | Quire et al. | 482/91 |
| 3,491,751 | 1/1970 | Wolfing | 128/28 |
| 3,503,388 | 3/1970 | Cook | 128/28 |
| 3,659,843 | 5/1972 | Kojigian, Jr. | 482/139 |
| 3,809,394 | 5/1974 | Hall | 272/176 |
| 4,441,707 | 4/1984 | Bosch | 272/119 |
| 4,540,173 | 9/1985 | Hopkins, Jr. | 272/139 |
| 4,824,105 | 4/1989 | Goldenberg | 482/113 |
| 4,863,159 | 9/1989 | Brown, Jr. | 272/902 X |
| 5,005,832 | 4/1991 | Van Der Hoven | 482/124 |

FOREIGN PATENT DOCUMENTS

| | | |
|---|---|---|
| 20463 | of 1908 | United Kingdom . |
| 429059 | 5/1935 | United Kingdom . |
| 451516 | 8/1936 | United Kingdom . |

OTHER PUBLICATIONS

"Owner's Manual of Lifestyler 2200 Multiaction Rower" by Sears, 1987.

*Primary Examiner*—Richard J. Apley
*Assistant Examiner*—Joe H. Cheng
*Attorney, Agent, or Firm*—Michael Sand Co.

[57] ABSTRACT

An abdominal exercising device having two identical structures, each comprised of a rigid member, pressure pad and handle, are connected by an adjustable strap adapted to partially encircle the users abdominal area. After the user obtains the standard sit-up crunch or leg lift position, the adjustable strap is placed under the lower back while the two structures are brought across the abdominal area with each structures pressure pad contacting the users abdominal muscles. The user holds both handles and applies pressure to the abdominal muscles by simultaneously pulling the handles in toward the torso while performing the exercise movement.

7 Claims, 2 Drawing Sheets

ABDOMINAL EXERCISING DEVICE

This application is a continuation application under 37 CFR 1.62 of prior application Ser. No. 07/795,289, filed Nov. 19, 1991 which is a continuation of Ser. No. 07/557,618, filed Jul. 24, 1990, both abandoned.

FIELD OF INVENTION

The present invention relates to exercise devices, specifically to a portable device that is placed around the users midsection which permits the user to apply external pressure directly to the abdominal muscles during exercise, therefore resulting in more efficient development of the abdominal muscles.

DESCRIPTION OF PRIOR ART

Many sports require that the participants possess strong abdominal muscles, particularly sports such as boxing, karate and body building. Various abdominal exercises as well as abdominal exercise machines are used to develop the abdominal muscles, all of which use the principle of contracting the abdominal muscles against a resistance, for example: in performing sit-ups the abdominal muscles are contracted against the resistance supplied by the weight of the upper torso.

This principle of contracting the abdominal muscles against a resistance is adequate for developing the abdominal muscles. However, it requires that many repetitions of the exercise movement be performed over a long period of time to achieve noticeable results.

Heretofore there have been no exercise devices able to increase the effectiveness of an abdominal exercise movement employing the principle of muscle contraction, whether said exercise movement is performed on a machine using weights for added resistance or performed without artificial resistance such as sit-ups or crunches. Accordingly it can be appreciated that an individual performing contraction type exercises would find it desirable to have a device which could increase the effectiveness of these abdominal exercises thereby decreasing the number of repetitions that have to be performed.

OBJECTS OF THE INVENTION

It is an object of the present invention to provide an abdominal exercising device which when used while performing abdominal exercises such as but not limited to sit-ups, crunches or leg lifts will allow the user to apply external pressure to the abdominal muscles therefore substantially facilitating the strengthening of said abdominal muscles.

It is another object of the present invention to provide an abdominal exercise device that can be adjusted to fit the users waist size.

It is an object of the present invention to provide an abdominal exercising device that is simple to manufacture.

It is an object of the present invention to provide an abdominal exercising device that is simple to use.

It is an object of the present invention to provide an abdominal exercise device that has handles which can be adjusted to alternate positions.

Further objects and advantages of the present invention will become apparent from a consideration of the drawings and ensuing description of the invention.

DESCRIPTION OF DRAWING FIGURES

DESCRIPTION OF THE PREFERRED EMBODIMENT

Figure 1:
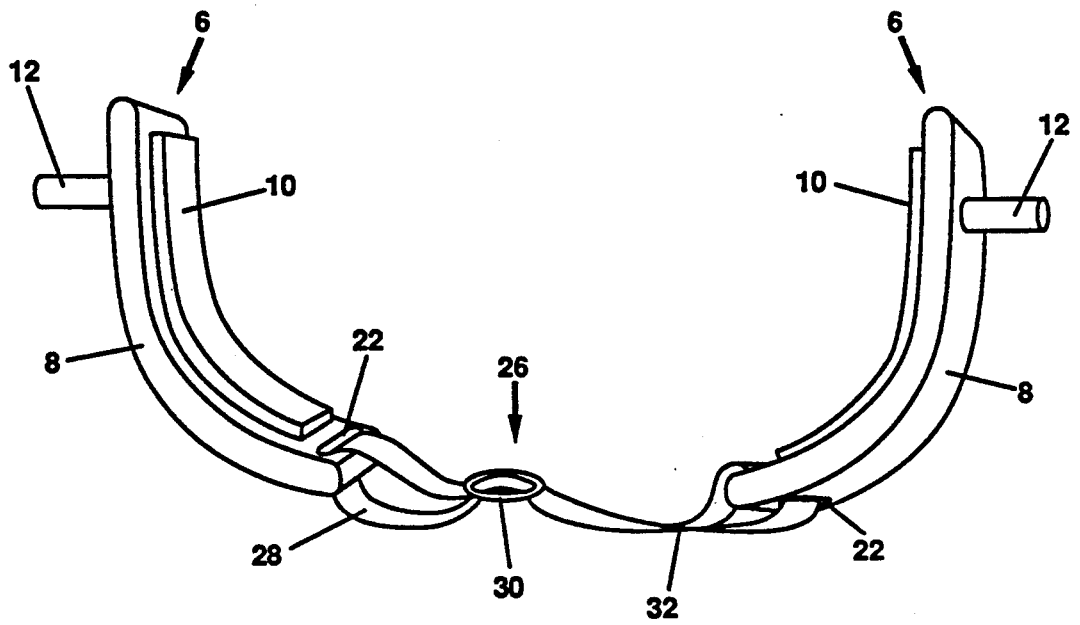
FIG. 1 Is a perspective side view showing the principles of the abdominal exercising device.

FIG. 1 shows the abdominal exercising device according to the preferred embodiment of the invention. The abdominal exerciser comprises two identical structures 6 connected together by adjustable strap assembly 26.

Figure 2:
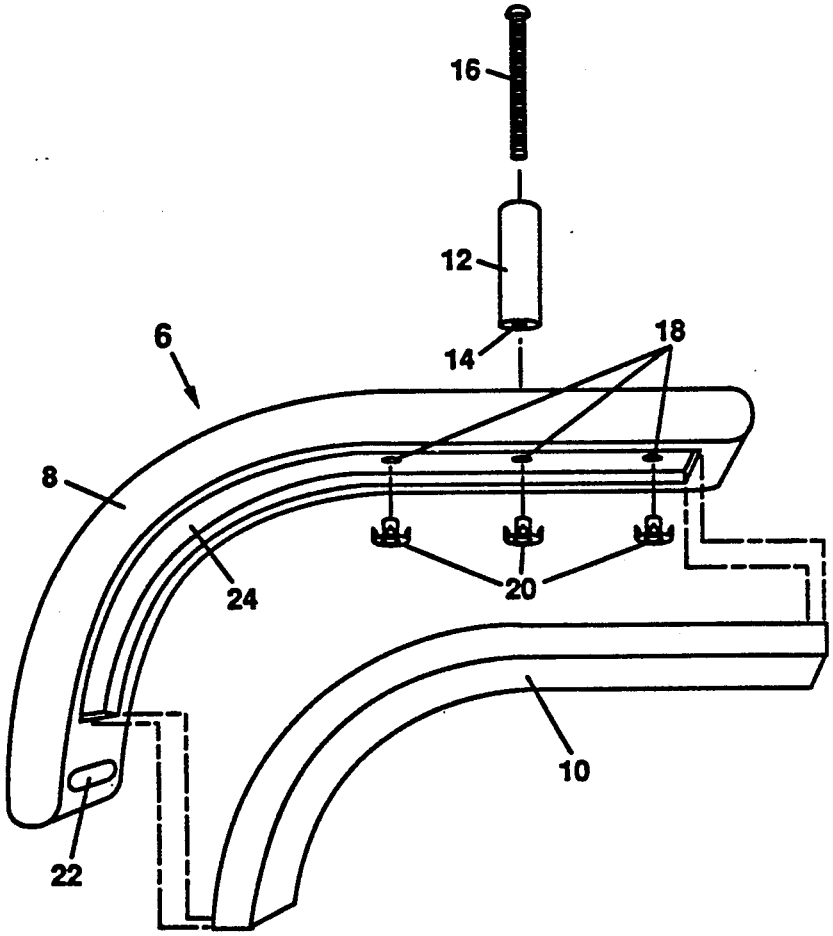
FIG. 2 Is an exploded view showing one of the abdominal exercisers two identical structures.

The identical structures 6 are illustrated in the exploded view of FIG. 2. Each structure 6 is comprised of a rigid member, 8, pressure pad 10, handle 12, handle screw 16 and handle screw T nut 20.

The adjustable strap assembly 26 shown in FIG. 1 is comprised of a non-elastic strap 28 and a strap adjustment buckle 30.

Referring again to the structure 6 shown in FIG. 2, it can be seen that the handle 12 is fastened to the rigid member 8 by the handle screw 16 and handle screw T nut 20. The handle screw 16 passes through a handle screw bore 14 in handle 12 then through a handle mounting bore 18 in rigid member 8 to the handle screw T nut 20. The rigid member 8 contains three handle mounting bores 18 and three handle screw T nuts 20, any of which can be used to mount the handle according to the users preference.

The pressure pad 10 is fastened onto the pressure pad attachment cavity 24 with any adhesive capable of bonding the pressure pad material to the rigid member material.

The two identical structures are connected together by the adjustable strap assembly 26 as follows: one end of the non-elastic strap 28 is attached to the center bar of strap adjustment buckle 30. The remaining end of the non-elastic strap 28 is passed through the opening 22 in the first rigid member 8 and then brought back through the strap adjustment buckle 30 and then through opening 22 in the second rigid member 8 and finally attached back to itself at strap attachment point 32.

The preferred materials for the abdominal exercise device are as follows:

| Item | Preferred Material |
|---|---|
| Rigid members | Plastic |
| Pressure pads | Foam |
| Strap | Non-elastic nylon |
| Buckle | Plastic |
| Handle | Plastic |
| Screw | Steel |
| T nut | Steel |

While the above description contains many specifics, the reader should not construe these as limitations on the scope of the invention, but merely as exemplifications of preferred embodiments thereof. Those skilled in the art will envision many other possible variations that are within the inventions scope. For example, skilled artisans will readily be able to change the dimensions and shapes of the preferred embodiment. They will also be able to make the invention of alternate materials such as wood or metal. They can make many variations on the shape of the pressure pads 10 shown in FIG. 2, i.e. the bottom surface of the pressure pads, which contacts the user's abdominal muscles, can be ribbed in a lengthwise manner, striated, dimpled or protrude in various manners so as to contact the user's abdominal muscles at various points, depending on the shape of said pressure pad. They can completely eliminate the pressure pad if cushioning of the abdominal muscles is not desired. They can make the shape of the rigid member 8 concave from opening 22 to the last handle screw bore 18 so as to better conform to the user's abdominal area. They can make variations on the adjustable strap assembly 26, i.e.: the strap can use hook and loop attachment material such as a product commercially available under the trademark VELCRO instead of a strap adjustment buckle 30 for adjusting length. They can also use standard nuts for fastening the handle 12 and handle screw 16 to the rigid member 8. Accordingly, the reader is requested to determine the scope of the invention by the appended claims and their equivalents and not by the examples which have been given.

OPERATION

Figure 3:
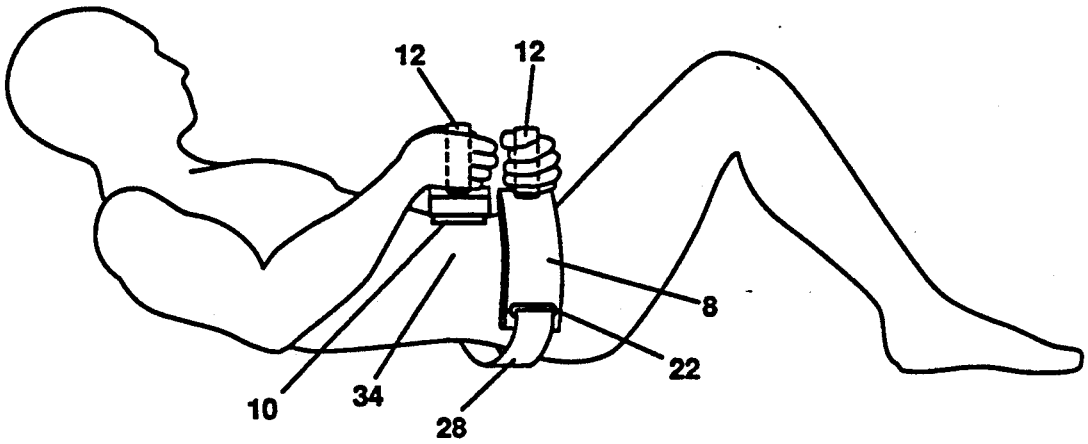
FIG. 3 Is a plan view of the abdominal exercising device being manipulated by the user in the sit-up, crunch or leg lift position.
Figure 4:
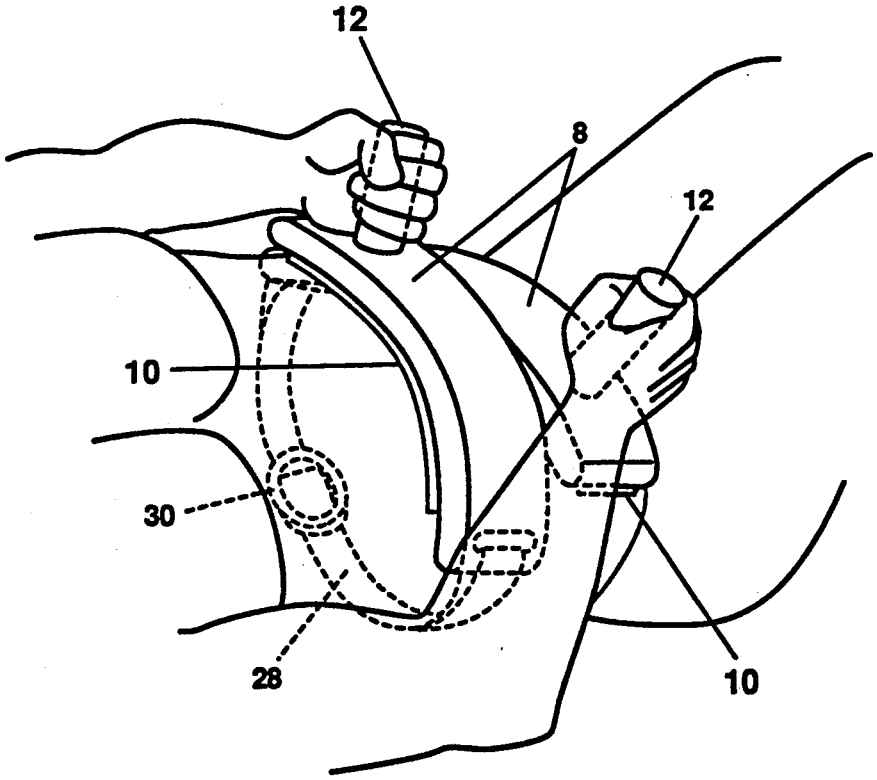
FIG. 4 Is a perspective view of the abdominal exercising device showing the device engaged around the midsection of the user, ready for operation, the user's torso, hands and arms being partially shown.

In FIGS. 3 and 4, the abdominal exercising device is shown in use. FIG. 3 shows a plan view of the abdominal exerciser and FIG. 4 shows a perspective view. To operate, the user assumes the sit-up, crunch or leg lift position with the adjustable strap assembly 26 positioned under the user's lower back. The user then crosses structures 6 over the abdominal region so that both structures' pressure pads 10 contact the abdomen as shown in FIGS. 3 and 4. The user grasps both handles 12 and begins performing repetitions of the exercise movement. During each repetition of the exercise movement, the user simultaneously pulls the handles 12 away from each other and toward the user's body. This pulling of handles 12 results in pressure being put on the user's abdominal muscles 34, resulting in more efficient development of said abdominal muscles.

I claim:

1. A manually operated exercising device for applying external pressure to a user's external oblique and rectus abdominis muscles comprising:

a) first and second structures, each of sufficient size and shape to substantially cover said user's external oblique and rectus abdominis muscles, and each of said first and second structures comprised of:

1) a rigid member having a contoured shape, and having a bottom surface configured to contact said user's external oblique and rectus abdominis muscles, and 2) a handle attached to each of said rigid members for grasping by the user and simultaneously applying external pressure to said user's external oblique and rectus abdominis muscles during an abdominal exercise; and b) strap means connected to and extending between said rigid members for extending about the user's back to position said rigid members at the user's oblique and rectus abdominis muscles.

2. The exercising device of claim 1 wherein each of said handles is orthogonally disposed to its respective rigid member.

3. The exercising device of claim 1 wherein said bottom surface of each rigid member is striated.

4. The exercising device of claim 1 wherein said bottom surface of each rigid member is dimpled.

5. The exercising device of claim 1 wherein each of said rigid members is provided with three bores for the mounting of said handle.

6. The exercising device of claim 1 wherein said bottom surface of each rigid member is padded.

7. The exercising device of claim 1 including means for adapting the length of said strap means.

* * * * *